US005383875A

United States Patent [19]

Bays et al.

[11] Patent Number: 5,383,875

[45] Date of Patent: Jan. 24, 1995

[54] SAFETY DEVICE FOR A POWERED SURGICAL INSTRUMENT

[75] Inventors: Rodney Bays, Pierceton, Ind.; Michael L. Boulton, Oaji; John H. Pascaloff, Goleta, both of Calif.; Gregory C. Stalcup, Columbia City, Ind.; Dai N. Vu, Ventura, Calif.

[73] Assignee: Zimmer, Inc.

[21] Appl. No.: 251,449

[22] Filed: May 31, 1994

[51] Int. Cl.[6] ..... H01H 3/20

[52] U.S. Cl. ..... 606/1; 606/42; 200/43.17; 200/334

[58] Field of Search ..... 606/1, 41, 42, 45, 49; 200/43.16, 43.17, 43.19, 43.22, 334, 293.1

[56] References Cited

U.S. PATENT DOCUMENTS

| | | | |
|---|---|---|---|
| 3,366,764 | 1/1968 | Korshak et al. | 200/334 X |
| 3,574,374 | 4/1971 | Keller et al. . | |
| 3,746,813 | 7/1973 | Brown | 200/43.17 |
| 4,276,459 | 6/1981 | Willett et al. | 200/43.17 |
| 4,376,240 | 3/1983 | Stuart | 200/43.17 |
| 4,655,215 | 4/1987 | Pike | 606/45 X |
| 4,882,458 | 11/1989 | Berg et al. | 200/43.17 X |
| 4,910,365 | 3/1990 | Kuo | 200/43.16 |
| 5,219,348 | 6/1993 | Buess et al. | 606/45 X |

OTHER PUBLICATIONS

Hall Surgical—"The Hall Sterile Blade and Bur Book," 1986 Hall Surgical, Lt. No. 97-3000-320 10MH.

*Primary Examiner*—Peter A. Aschenbrenner
*Attorney, Agent, or Firm*—Todd A. Dawson

[57] ABSTRACT

A control lever assembly adapted for use with a powered surgical instrument which prevents the instrument from being inadvertently or accidentally activated. The assembly 10 includes a depressible control lever 20 for controlling the action of the instrument and a second safety lever or latch 30 which engages the trigger pin 6 of instrument only when selectively positioned with respect to control lever 20. Control lever 20 is secured to cutting device 2 by a mounting bracket 12. Safety latch 30 is pivotally carried by control lever 20 for shiftable movement between a safety position and an operational position. In the operational position, safety latch 30 engages trigger pin 6 when control lever 20 is depressed. Safety latch 30 cannot be switched from its safety position to its operational position when control lever 20 is depressed; therefore, the instrument is "locked-out" and cannot be inadvertently activated even when control lever 20 is depressed. Safety latch 30 can only be manually shifted from the safety position to the operational position when control lever 20 is released, which ensures safe handling of the instrument.

14 Claims, 4 Drawing Sheets

SAFETY DEVICE FOR A POWERED SURGICAL INSTRUMENT

This invention relates to a control lever assembly used to activate a powered surgical instrument, and in particular, a control a lever assembly for a hand held powered surgical instrument that includes a safety mechanism which prevents the instrument from being inadvertently activated.

BACKGROUND OF INVENTION

Hand held powered surgical instruments are well known in the medical field. In general, the operation of such instruments are controlled by depressing a trigger pin which extends from the body of the instrument. Most conventional hand held instruments include an external control lever for manually controlling the downward pressure applied to the trigger pin thereby controlling the operation of the instrument. The control lever allows the instrument to be easily activated and manipulated with one hand. Since the control lever is exposed, incorporating a safety mechanism into the control lever is desirable to prevent the instrument from being inadvertently activated during handling. Ideally, a safety mechanism should be operable with one hand and cooperate with the control lever.

SUMMARY OF INVENTION

The control lever assembly of this invention prevents the instrument from being inadvertently or accidentally activated. The invention includes a depressible control lever for controlling the action of the instrument and a second safety lever or latch which engages the trigger pin of the instrument only when selectively positioned with respect to the control lever.

The control lever is secured to the cutting device by a mounting bracket. The safety latch is pivotally carried by the control lever for shiftable movement between a safety position and an operational position. In the operational position, the safety latch engages the trigger pin when the control lever is depressed. The safety latch cannot be switched from its safety position to its operational position when the control lever is depressed; therefore, the instrument is "locked-out" and cannot be inadvertently activated even when the control lever is depressed. The safety latch can only be manually shifted from the safety position to the operational position when the control lever is released, which ensures safe handling and operation of the instrument.

In one embodiment of the invention, the safety latch includes an arm and a contact part which is pivotally connected to the control lever. The safety latch is pivotally carried by the control lever so that the contact part overlies the trigger pin of the instrument. The contact part has an opening which is positioned for receiving the trigger pin when the safety latch is in its safety position. When the control lever is depressed and the trigger pin extends into the opening in the contact part, the safety latch is prevented from being rotated to its operational position by the engagement of the pin within the contact opening. In the operational position, the safety latch is rotated away from the control lever so that the contact part engages the trigger pin to activate the instrument when the control lever is depressed.

In a second embodiment, the safety latch has a bent configuration and includes an arm and a contact part. The safety latch is pivotally carried by the control lever. In the operational position, the arm overlies the control lever and the contact end overlies the trigger pin. In the operational position, when the control lever is depressed, the contact part engages the trigger pin to activate the instrument. In the safety position, the arm is biased away from the control lever and the contact part is pivoted out of alignment with the trigger pin. When the control lever is depressed, the contact part engages the mounting bracket adjacent the trigger pin. If the control lever is depressed and the safety latch is in its safety position, the safety latch cannot be pivoted from the safety position to an operational position because the contact part is blocked by a raised partition protruding from the mounting bracket.

Accordingly, an advantage of this invention is to provide for a control lever assembly used with a powered surgical instrument that prevents the instrument from being inadvertently or accidentally activated.

Another advantage of this invention is to provide for a control lever assembly used with a hand held powered surgical instrument that includes a control lever for manually controlling the operation of the instrument and a safety latch carried by the control lever for engaging the trigger pin only when the safety latch is manually shifted to an operational position.

Another advantage of this invention is to provide a control lever assembly that prevents the safety latch from being shifted from a safety position to an operational position when the control lever is in an activated position.

Another advantage of this invention is to provide a control lever assembly that includes a depressible control lever and a safety latch which is independent of the action of the control lever.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to explain the principles of the invention and its application and practical use to enable others skilled in the art to utilize its teachings.

For illustrative purposes only, both embodiments of this invention are shown as part of a hand held pneumatic powered device, such as the one manufactured by Hall Surgical of Santa Barbara, Calif. The control lever assembly of this invention can be adapted for use with any powered device and the invention is not intended to be limited by its application to any particular device. As shown in the figures, the instrument 2 includes a body 4 and a depressible trigger pin 6 which extends laterally from the side wall of body 4. As is common in powered surgical instruments, instrument 2 is activated by depressing trigger pin 6. The control lever assembly of this invention is used to facilitate safe operation of the instrument.

Figure 1:
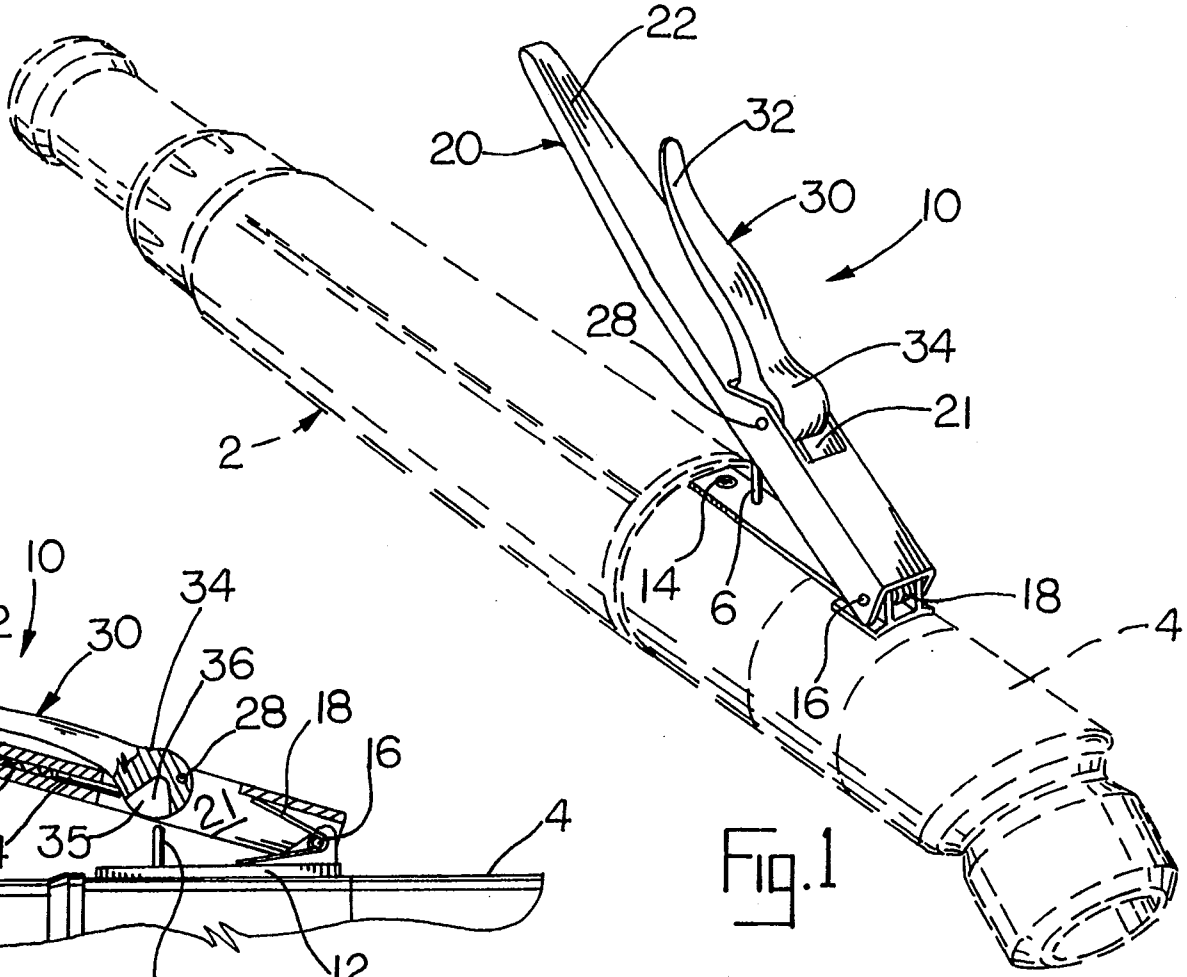
FIG. 1 is a perspective view of one embodiment of the control lever assembly of this invention shown with a powered surgical instrument (illustrated in broken lines)

FIGS. 1–4 show control lever assembly 10, which is the preferred embodiment of this invention. Control lever assembly 10 includes a control lever 20 pivotally connected to body 4 by a mounting bracket 12 and a safety lever or latch 30 carried by the control lever 20. Bracket 12 is secured to body 4 of the instrument by two screws 14 (only one is shown in FIG. 1). Trigger pin 6 extends through a bore in bracket 12. Control lever 20 is connected to bracket 12 by a pivot pin 16, as shown in FIG. 1. Pivot pin 16 extends through a spring 18 for biasing control lever 20 away from body 4 and bracket 12. Control lever 20 has an elongated body 22 shaped generally as shown in FIG. 1 and a central opening 21 for receiving safety lever 30.

Figure 2:
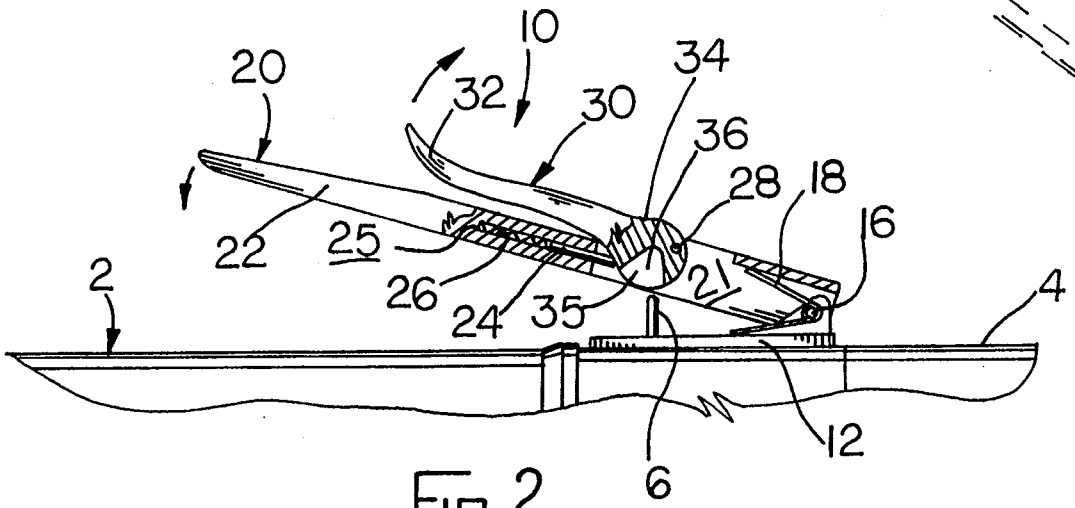
FIG. 2 is a partial sectional view of the invention showing the control lever in a released position and the safety latch in a safety or lock-out position.
Figure 3:
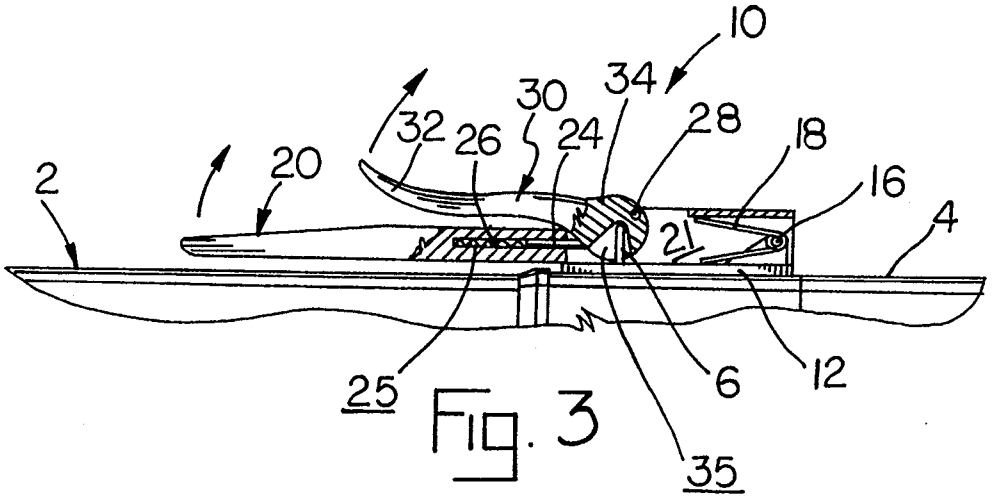
FIG. 3 is the sectional view of the invention of FIG. 2 showing the control lever in a depressed position against the body of the instrument and the safety latch in its safety position.
Figure 4:
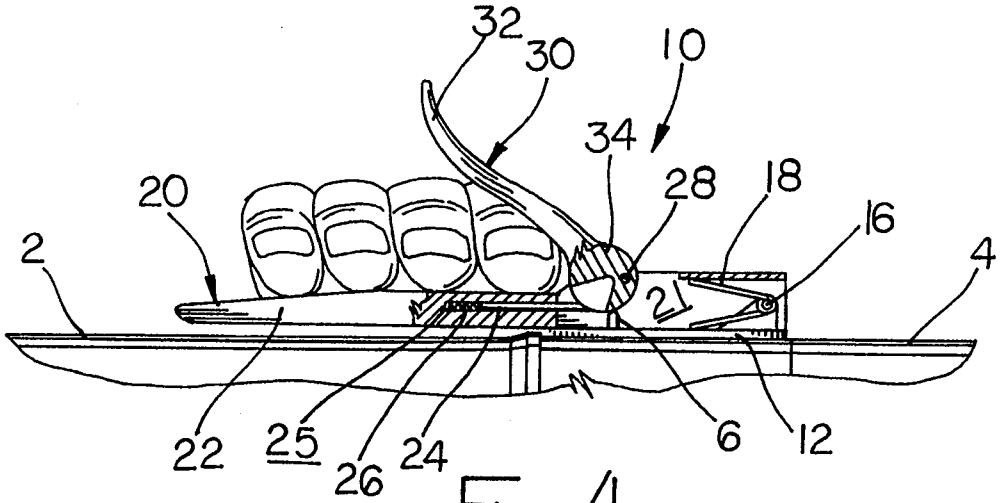
FIG. 4 is the sectional view of the control lever assembly of FIG. 2 showing the control lever in its depressed position against the body of the instrument and the safety latch in an operational position engaging the trigger pin.

As shown, safety lever 30 includes an arm 32 and an integral cam part 34. As shown in FIGS. 1–4, arm 32 overlies the proximal end of control lever 20 and cam part 34 is pivotally seated within lever opening 21. Arm 32 is curved slightly to allow the operator to slide their fingers under latch arm 32 to pivot safety latch 30 into its operational position (See FIG. 4). Safety latch 30 is pivotally connected to control lever 20 by a pivot pin 28 which extends through the side walls for lever body 22 and through a lateral bore in contact part 34. As shown in FIGS. 2–4, the lower surface of cam part 34 has a receiving opening or cavity 35. In addition, a shoulder 36 is formed on each side of contact part 34. Two compression rods 24 (only one shown, see FIG. 4), extensibly protrude into lever opening 21 from two longitudinal bores 25 (only one shown) in lever body 22. Compression rods 24 engage one of the shoulders 36 on each side of contact part 34. A spring 26 is disposed within each bore 23 to urge compression rod 24 into engagement against shoulders 36 to bias safety latch 30 in its safety position (FIGS. 2 and 3).

FIGS. 2–4 illustrate the operation and safety features of the control lever assembly 10. Control lever 20 is pivotable between a released position (FIG. 2) and a depressed position (FIG. 3 and 4). Safety latch 30 is manually pivotable between a released safety position (FIGS. 2 and 3) and an operational position (FIG. 4). As shown in FIGS. 2 and 3, opening 35 overlies trigger pin 6 and does not engage the trigger pin when safety latch 30 is in its safety position, even when control lever 20 is fully depressed. When control lever 20 is fully depressed as shown in FIG. 3, trigger pin 6 extends into opening 35. It should be noted from FIG. 3 that safety latch 30 cannot be switched from its safety position to its operational position when control lever 20 is depressed, because trigger pin 6 inhibits the rotational movement of safety latch 30.

To activate instrument 2, safety latch 30 must be manually pivoted away from control arm 20 into its operational position when control arm 20 is in its released position. Then, control arm 20 can be depressed to activate the instrument as shown in FIG. 4. With safety latch 30 rotated to the operational position, trigger pin 6 is depressed by the outer surface of cam part 34. Safety latch 30 must be manually maintained in its operational position. In use, a surgeon slides one or two of their fingers between the safety latch 30 and control lever 20 as they squeeze lever 20 toward instrument 2 (See FIG. 4). When the surgeon removes their fingers from between the safety latch 30 and control lever 20, compression rods 24 automatically rotate safety latch 30 out of engagement with trigger pin 6, thereby terminating the operation of the cutting device.

Figure 5:
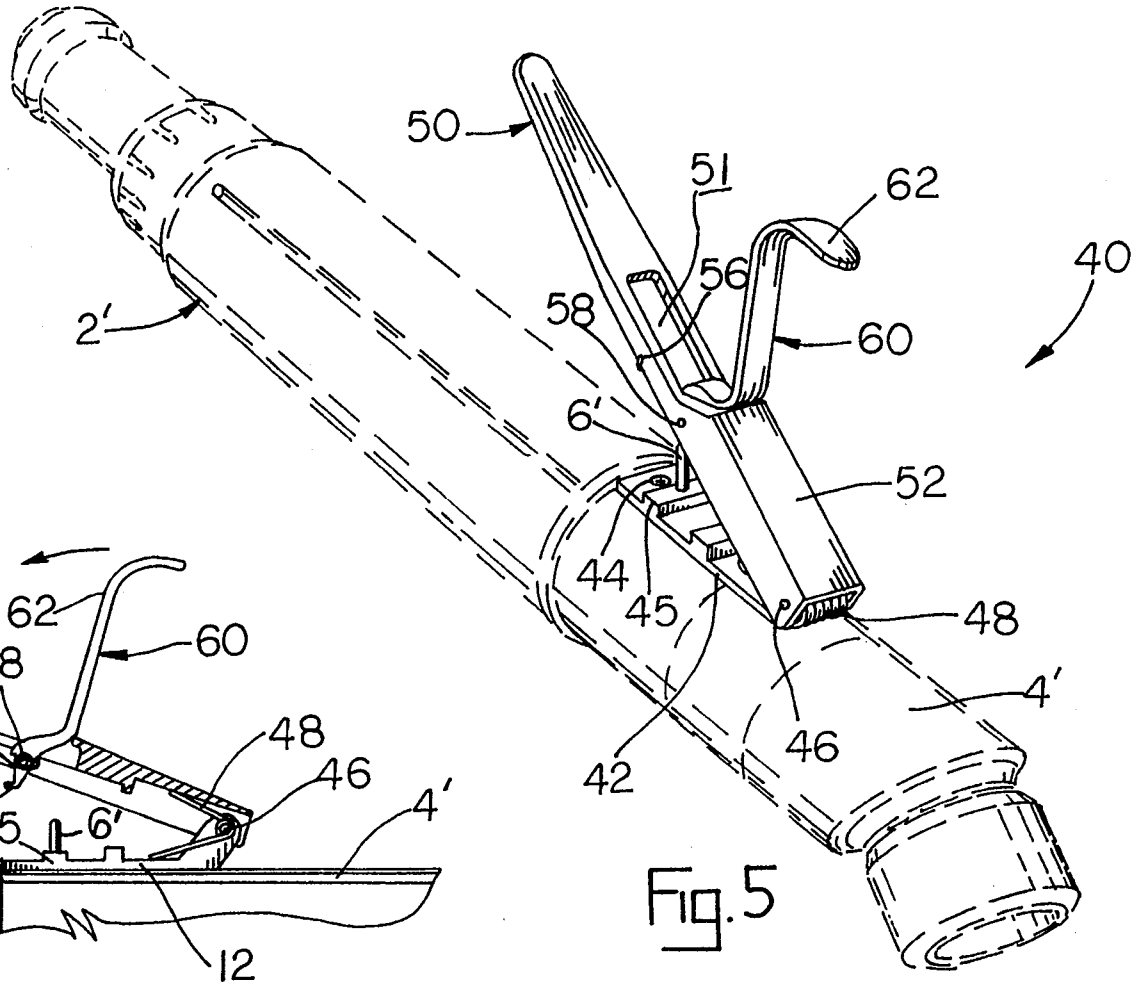
FIG. 5 is a perspective view of one embodiment of the control lever assembly of this invention shown with a powered surgical instrument (illustrated in broken lines)
Figure 6:
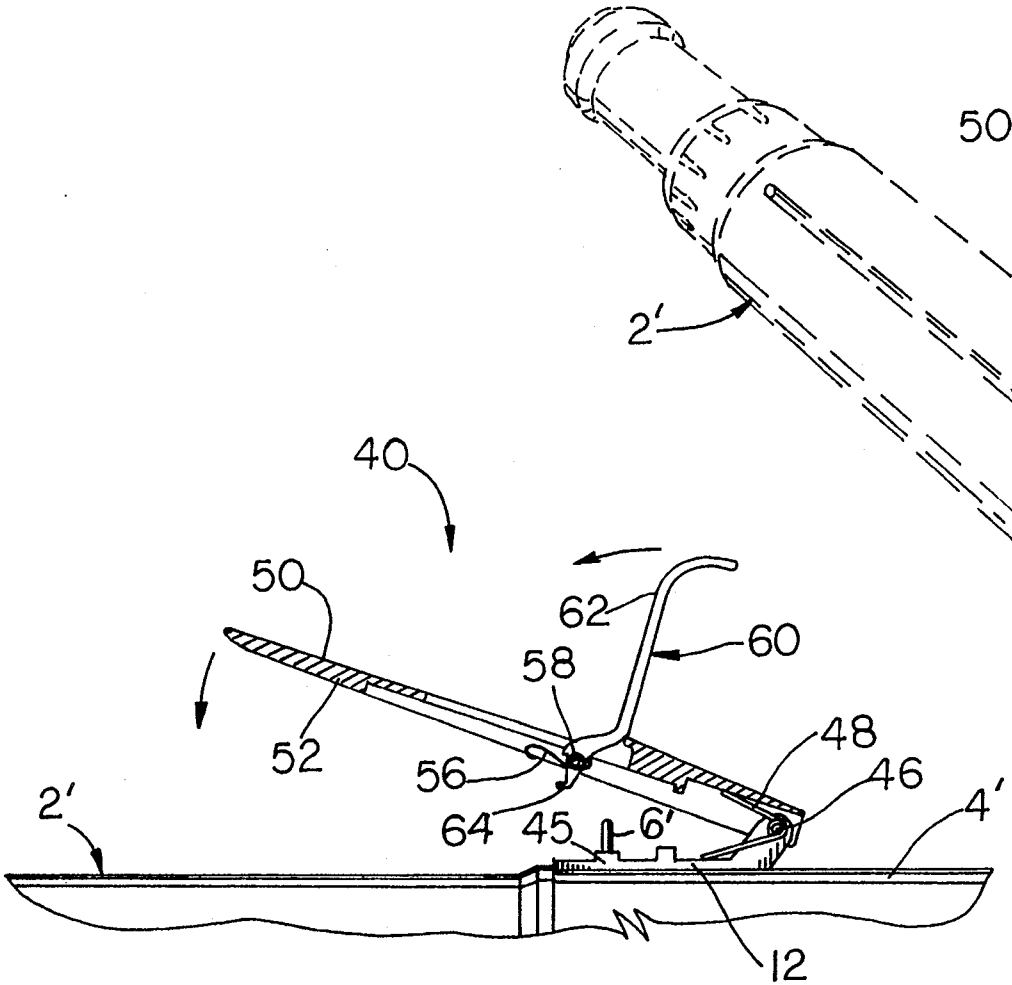
FIG. 6 is a partial sectional view of the invention of FIG. 5 showing the control lever in a released position and the safety latch in a safety or lock-out position.
Figure 8:
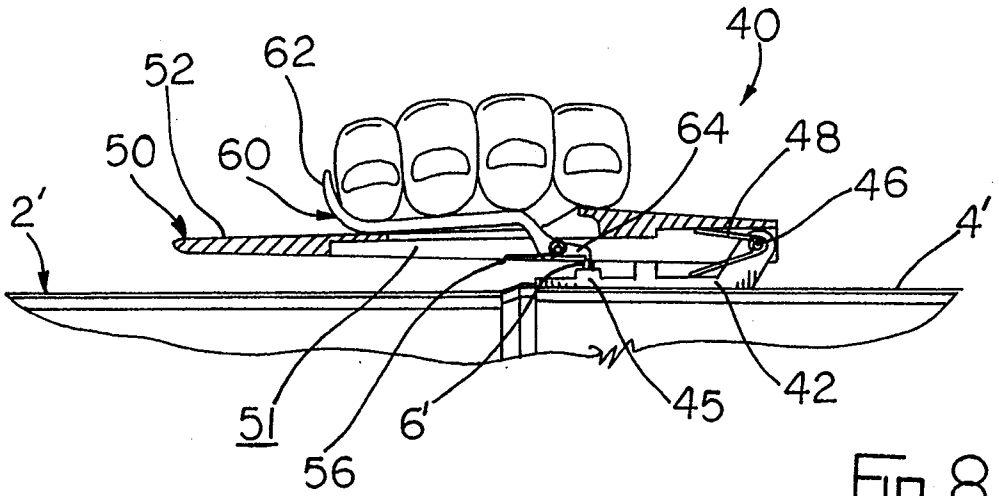
FIG. 8 is a partial sectional view of the invention of FIG. 5 showing the control lever in its depressed position against the body of the instrument and the safety latch in an operational position engaging the trigger pin.
Figure 7:
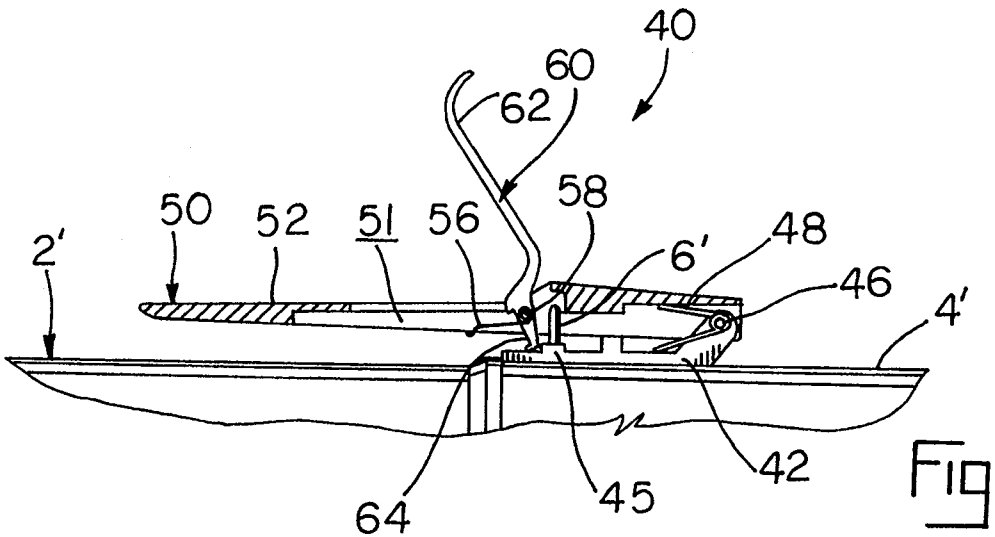
FIG. 7 is a partial sectional view of the invention of FIG. 5 showing the control lever in a depressed position against the body of the instrument and the safety latch in its safety position.

FIGS. 5–8 show a second embodiment of the control lever assembly of this invention used with an instrument 2'. Control lever assembly 40 includes a control lever 50 pivotally connected to body 4' by a mounting bracket 42 and a safety latch 60 carried by the control lever 50. Bracket 42 is secured to body 4' by two screws 44 (only one is shown in FIG. 5). Bracket 42 has a raised partition 45 on its upper surface. Trigger pin 6' extends through a bore in partition 45. Control lever 50 is connected to bracket 42 by a pivot pin 46, as shown in FIG. 1. Pivot pin 46 extends through a spring 48 for biasing control lever 50 away from body 4'. Control lever 50 has an elongated body 52 shaped generally as shown in FIG. 1 and a central opening 53 for receiving safety lever 60. As shown in FIGS. 6–8, safety lever 60 has generally a S-shaped configuration with a curved arm 62 and a contact part 64. Arm 62 is curved to allow the operator to hook his fingers about arm 62 to facilitate switching safety latch 30 to its operational position (FIG. 8). Arm 60 is connected within lever opening 51 by a pivot pin 58. Pivot pin 58 extends through a spring 56 which is connected at its opposite ends to control lever 50 and safety latch 60. The tension of spring 56 holds safety latch 60 in its safety position (FIGS. 6 and 7).

FIGS. 6–8 illustrate the operation and safety features of the control lever assembly 40. Control lever 50 is pivotable between a released position (FIG. 6) and a depressed position (FIG. 3 and 4). Safety latch 60 is manually pivotable between a safety position (FIGS. 6 and 7) and an operational position (FIG. 8). In its safety position, arm 62 is pivoted away from control ever 50 and contact part 64 is pivoted away from trigger pin 6'. With safety latch 60 in the safety position, when control lever 50 is depressed as shown in FIG. 7, trigger pin 6' extends unimpeded into central opening 51. It should be noted from FIG. 7 that contact part 64 abuts bracket 42 when control lever 50 is depressed and safety latch 60 is not. In addition, in the position of FIG. 7, safety lever 60 cannot be pivoted from its safety position to its operational position when control arm 50 is depressed, because rotational movement of contact part 64 is impeded by raised partition 45 of bracket 42.

To activate instrument 2', safety latch 60 must be manually pivoted toward control lever 50 to its operational position when control lever 50 is in its released position. Then, control lever 50 can be depressed to activate the instrument as shown in FIG. 8. With safety latch 60 rotated to the operational position, trigger pin 6' is depressed by contacting part 64 as control lever 50 is depressed. Safety latch 60 must be manually maintained in its operational position. In use, the surgeon rests one of their fingers in the hooked portion of safety latch 60 as control lever 50 is depressed. Spring 56 automatically rotates safety latch 30 out of engagement with trigger pin 6' when manual pressure is released thereby terminating the operation of the instrument. Consequently, the operation of the instrument is terminated once the operator releases their grip on safety latch 60 and control lever 50.

It is understood that the above description does not limit the invention to the details given, but may be modified within the scope of the following claims.

I claim:

1. In combination, a powered surgical instrument including a body and a depressible pin extending from said body which activates said instrument when depressed and an apparatus for depressively engaging said pin, said apparatus comprising:

a first lever connected to said body for pivotal movement between a released position wherein said first lever is spaced from said body and a depressed position wherein said first lever is adjacent said body, and a second lever shiftably carried by said first lever for pivotal movement relative to said first lever between a first position and second position, said second lever includes a contact part adapted for forcefully engaging said pin to activate said instrument when said second lever is in its second position and said first lever is in its depressed position.

2. The combination of claim 1 wherein said contact part has an opening, said pin is seated within said opening when said second lever is in its said first position and said first lever is in its depressed position whereby said pin is shielded from depressive contact.

3. The combination of claim wherein said second lever includes an arm part adapted for facilitating pivotal movement of said second lever between its said first position and its said second position, said arm part overlies said first lever when said second lever is in one of said first position and said second position, said arm part is spaced from said first lever when said second lever is in the other of said first position and said second position.

4. The combination of claim 1 wherein said contact part is spaced from said pin and abuts said body when said second lever is in its said first position and said first lever is in its depressed position whereby said pin is shielded from contact with said contact end and said second lever is prevented from shifting from its said first position to its said second position.

5. The combination of claim 1 wherein said first lever is connected to said body by a hinge means for pivotal movement between said released position and said depressed position.

6. The combination of claim 1 wherein said second lever also includes means for biasing said second lever to its said first position.

7. The combination of claim 2 wherein said second lever includes means for preventing said second lever from shifting from its first position toward its second position when said first lever is in its depressed position and second lever is it its first position.

8. An apparatus adapted for use with a powered device having a body and a depressible pin extending from said body which activates said device when depressed, said apparatus comprising:

a first lever adapted for pivotal connection to said body between a released position wherein said first lever is spaced from said body and a depressed position wherein said first lever is adjacent said body, and a second lever shiftably carried by said first lever for pivotal movement relative to said first lever between a first position and second position, said second lever includes a contact part adapted for forcefully engaging said pin to activate said device when said second lever is in its position and said first lever arm is in its depressed position.

9. The apparatus of claim 8 wherein said contact part has an opening, said pin is seated within said opening when said second lever is in its said first position and said first lever is in its depressed position.

10. The apparatus of claim 8 wherein said second lever includes an arm part adapted for facilitating pivotal movement of said second lever between its said first position and its said second position, said arm part overlies said first lever when said second lever is in one of said first position and said second position, said arm part is spaced from said first lever when said second lever is in the other of said first position and said second position.

11. The apparatus of claim 8 wherein said contact end is spaced form said pin and abuts said body when said second lever is in its said first position and said first lever is in its depressed position whereby said pin is shielded from contact with said contact end and said second lever is prevented from shifting from its said first position to its said second position.

12. The apparatus of claim 8 wherein said first lever is connected to said body by a hinge means for pivotal movement between said released position and said depressed position.

13. The apparatus of claim 8 wherein said lever part also includes means for biasing said second lever to its said first position.

14. The apparatus of claim 9 wherein said second lever includes means for preventing said second lever from pivoting from its first position when the first lever is in its depressed position and the first lever is in its depressed position.

* * * * *